United States Patent [19]

Kistner

[11] 4,420,747

[45] Dec. 13, 1983

[54] SHEET FEED MONITORING SYSTEM

[75] Inventor: Werner Kistner, Offenbach am Main, Fed. Rep. of Germany

[73] Assignee: M.A.N.-Roland Druckmaschinen Aktiengesellschaft, Fed. Rep. of Germany

[21] Appl. No.: 194,450

[22] Filed: Oct. 6, 1980

Related U.S. Application Data

[63] Continuation-in-part of Ser. No. 172,930, Jul. 28, 1980.

[30] Foreign Application Priority Data

Jul. 26, 1979 [DE] Fed. Rep. of Germany ..... 2930270

[51] Int. Cl.[3] ..... G08B 21/00

[52] U.S. Cl. ..... 340/674; 271/263

[58] Field of Search ..... 340/674; 271/263, 262, 271/258, 256

[56] References Cited

U.S. PATENT DOCUMENTS

| | | | |
|---|---|---|---|
| 2,963,293 | 12/1960 | Klein | 340/674 |
| 3,182,301 | 5/1965 | Kolb | 271/263 |
| 3,826,487 | 7/1974 | Förster et al. | 271/203 |
| 4,110,032 | 8/1978 | Hubbard et al. | 271/258 |
| 4,154,437 | 5/1979 | Butcheck et al. | 271/263 |
| 4,275,879 | 6/1981 | Yamashita et al. | 340/674 |

FOREIGN PATENT DOCUMENTS 2426642 11/1975 Fed. Rep. of Germany .

*Primary Examiner*—Glen R. Swann, III

*Attorney, Agent, or Firm*—Leydig, Voit, Osann, Mayer & Holt, Ltd.

[57] ABSTRACT

A system for detecting missing or superimposed sheets fed to a sheet processing machine uses a measuring device for generating a signal increasing with the number of superimposed sheets and an evaluating device for emitting an electrical signal when irregularities occur. A pulse transmitter is synchronized to the sheet feed mechanism and operates to emit an initial and final pulse timed to the sheet feed. Electronic storage is reset upon the initial pulse, and operates to integrate values of the measured signal until the final pulse is received. Upon receipt of the final pulse, the stored value is compared to a reference value to detect any irregularities. Preferably a microcomputer is used for signal processing.

10 Claims, 7 Drawing Figures

SHEET FEED MONITORING SYSTEM

CROSS REFERENCE TO RELATED APPLICATION

This is a continuation-in-part of Ser. No. 172,930, filed July 28, 1980.

BACKGROUND OF THE INVENTION

This invention relates to sheet processing machines and more particularly to a system for detection of irregularities in the sheet feed to such a machine.

DESCRIPTION OF THE PRIOR ART

Sheet feed detectors are known which are capable of producing an output having a value which increases with the number of superimposed sheets, and which do not have any appreciable effect on normal sheet travel. Measuring devices include mechanical sensors which detect the thickness of the sheet layer, capacitor circuits in which the sheet layer forms the dielectric, and radiation generators and detectors which measure the ability of the sheet layer to absorb photons, electrons, or ions. The measured value is a mechanical displacement or electrical signal which is usually compared to a stored reference value. The result of the comparison is an electrical binary signal used to stop the sheet processing machine. A simple mechanical system may use a single micro-switch. An electrical system could use a comparator to drive a relay.

A disadvantage encountered when using this approach is the high cost encountered in designing a measuring device which is not affected by interference and which can give repeatable results over a wide range of conditions. The sensor must be responsive to the number of superimposed sheets for different sheet thicknesses and materials and should distinguish between creases or curled edges and superimposed double sheets.

Electrical systems can be adapted to filter and otherwise process the measuring device signal to remove interference and enhance the measured value. For example, W. German Patent No. 2,426,642 (Offenlegungsschrift) describes an analog storage system that suppresses variations in the measured value to a greater extent the greater the frequency of these variations differs from a fixed frequency. The fixed frequency is the center frequency of a bandpass filter that effectively filters a signal representing the thickness of the fed sheets without gaps between the sheets. Thus the ideal center frequency is approximately the reciprocal of the time interval when the sheet is sensed by the measuring device. The operational reliability of a double sheet detector can be enhanced or simpler measuring devices can be used in conjunction with this method of signal processing.

A disadvantage of the method disclosed in W. German Patent No. 2,426,642 is that the center frequency of the analog filter does not track the velocity of the sheet feed if the velocity is variable. Even if the velocity is fixed, the analog filter passes excessive noise and interference compared to a filter that integrates the measured signal over the length of the sheet.

OBJECTS OF THE INVENTION

It is an object of this invention to provide a sheet feed monitoring system with a simple measuring device and a signal processing system with a response that is independent of the velocity of the sheet feed.

Additionally, it is an object of the present invention to filter the measured signal by integrating over the entire length of the sheet to obtain improved noise and interference rejection.

It is also an object of the invention to adjust for offset of the measuring device by providing automatic calibration of the measuring device during the start-up of the sheet feed mechanism.

Additionally, it is an object of the invention to provide automatic means for adjusting the evaluator to sheets of varying thickness while the sheet feed mechanism is running.

Yet another object of the invention is to provide automatic calibration as the system is running to compensate for periodically occuring faults and slow variations in sheet thickness.

SUMMARY OF THE INVENTION

In practicing the present invention, a measuring device generates a signal which increases with the number of superimposed sheets. A pulse transmitter generates an initial pulse when the sheet passes to the measuring device and a final pulse when the sheet passes from the measuring device. During the interval between the initial and final pulses, the measuring device is responsive to sheet thickness and the measuring device signal is integrated so that noise, interference and signal variations caused by creases and curled edges are uniformly suppressed over the interval. The integration is preferably done digitally by sampling the signal a large number of times and accumulating the results. The digital technique does not suffer from the offset and gain stability problems usually associated with analog integrators. Either by using an increased sampling rate with increased sheet feed velocity so that the number of samples is constant or by dividing the accumulated result by the number of samples, the gain of the filter is made independent of the feed velocity. The result of the integration is compared to a reference value to determine the number of sheets passing through the sheet feed mechanism. The preferred embodiment uses a microcomputer to store and retrieve values and to perform signal processing functions.

The offset of the measuring device is compensated for by processing the measuring device signal during a start-up cycle when a sheet is not present. The result of the integration is used to calculate the reference values.

The feed monitoring system also adapts itself to varying sizes of sheets and slow variations in sheet size by recomputing reference values based on the measured thickness of sheets previously fed by the sheet feed mechanism.

DESCRIPTION OF THE PREFERRED EMBODIMENT

Figure 1:
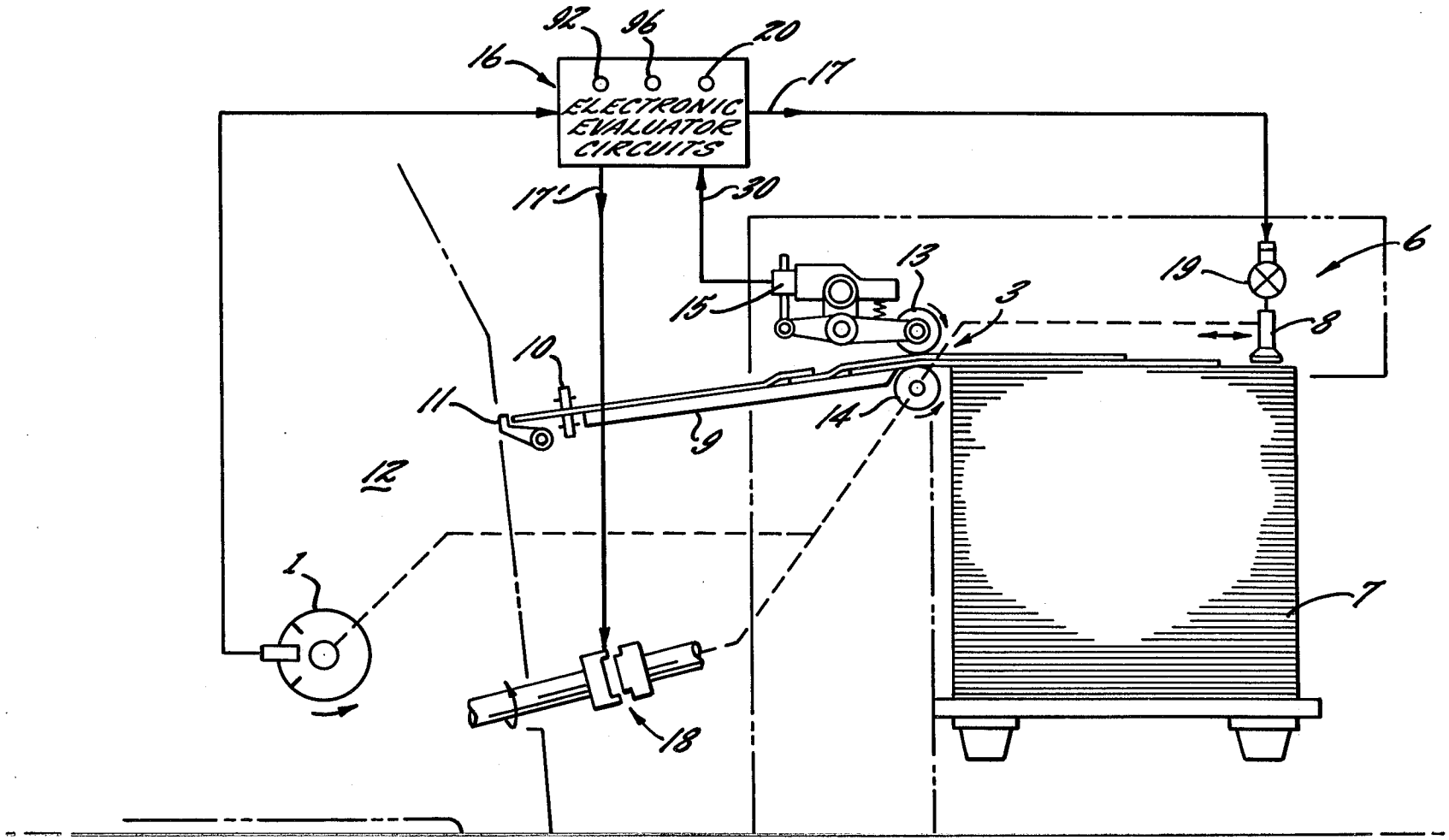
FIG. 1 schematically shows a printing press with a sheet feeder mechanism.

Turning now to the drawings, the arrangement in FIG. 1 shows a sheet feeder mechanism 6 with a feed pile 7, from which the sheets are taken by a sucker 8 and fed to the printing press 12 via a feeder board 9 and front-lay guides 10, 11.

Figure 2:
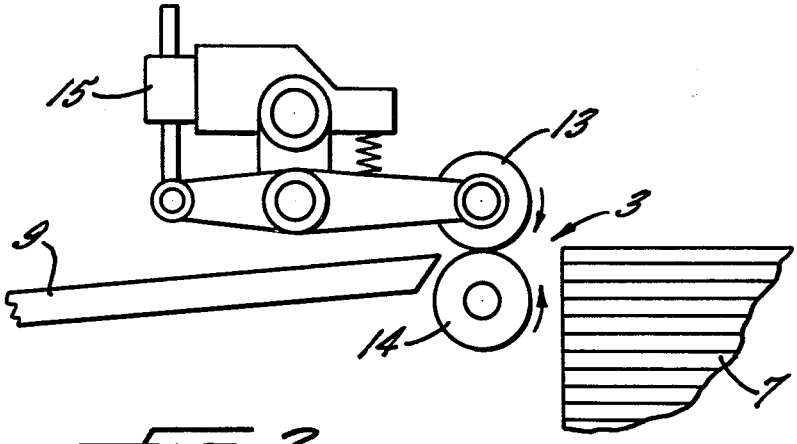
FIG. 2 shows a measuring device for the apparatus of FIG. 1.

A conveyor roller 13, which can be lifted by a suitable control system for feeding a new sheet, is provided in front of feeder board 9. This conveyor roller 13 is forcibly flexed against a lower roller 14. The distance between the rollers 13, 14 corresponds to the thickness of the sheet lying between the rollers and is measured by a displacement transmitter 15. The signal from the displacement transmitter 15 is fed to electronic evaluator circuits 16. The conveyor roller 13 and displacement transmitter 15 are shown in FIG. 2 on an enlarged scale.

Figure 3:
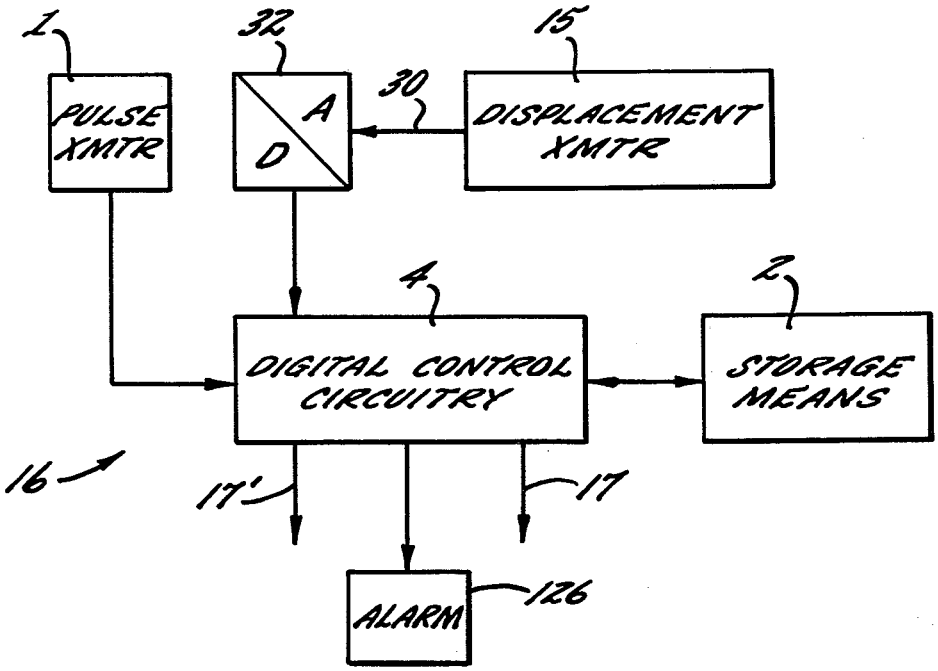
FIG. 3 is a block circuit diagram of the electronics associated with the measuring device.

The electronic circuits 16 cooperate with the displacement transmitter 15 and pulse transmitter 1 to detect double and/or missing sheets. A block diagram of the electronic circuits 16 is shown in FIG. 3. The digital control circuitry 4 samples the displacement transducer 15 via analog-to-digital converter 32 a large number of times, for example one hundred, between the initial and final synchronization pulses provided by the pulse transmitter 1. The samples are totalled in electronic storage means 2 which is reset on the initial synchronization pulse. On the final synchronization pulse, the total value in the electronic storage means 2 is compared to a reference value. A missing sheet is detected if the total does not exceed a lower threshold, and a double sheet is detected if the total exceeds an upper threshold, where the thresholds are displaced from the reference value by predetermined tolerances. Upon detection of a missing sheet, an output 17 disables the suction air via solenoid valve 19 and an alarm 126 is tripped so that an operator may, for example, refill the sheet feed pile 7. Upon detection of a double sheet, the alarm 126 is tripped and outputs 17 and 17′ disable the suction air via solenoid valve 19 and the mechanical drive to the sheet feed mechanism 6 via magnetic coupling 18 to shut down the machine. The operator may then, for example, remove the extra sheet which might otherwise jam the sheet flow.

A refinement of the digital control circuitry 4 may provide the capability of automatic testing and adjustment during a starting phase. After the electronics 16 are switched on, the feeder suction air is blocked by the solenoid valve 19 until self-testing and calibration is successful, which is signaled by a suitable indicator such as light-emitting diode (LED) 20. While the first four sheets successively pass through the feed rollers 13, 14 the build-up of the sheet stream is monitored and the reference valve for subsequent operation in the normal operating phase is calculated from the average displacement of the first four sheets. The calculation may be repeated using the previous four sheet measurements during the operation cycle to adaptively re-calibrate the reference. Thus manual checking and adjustment of the device are unnecessary.

Figure 4:
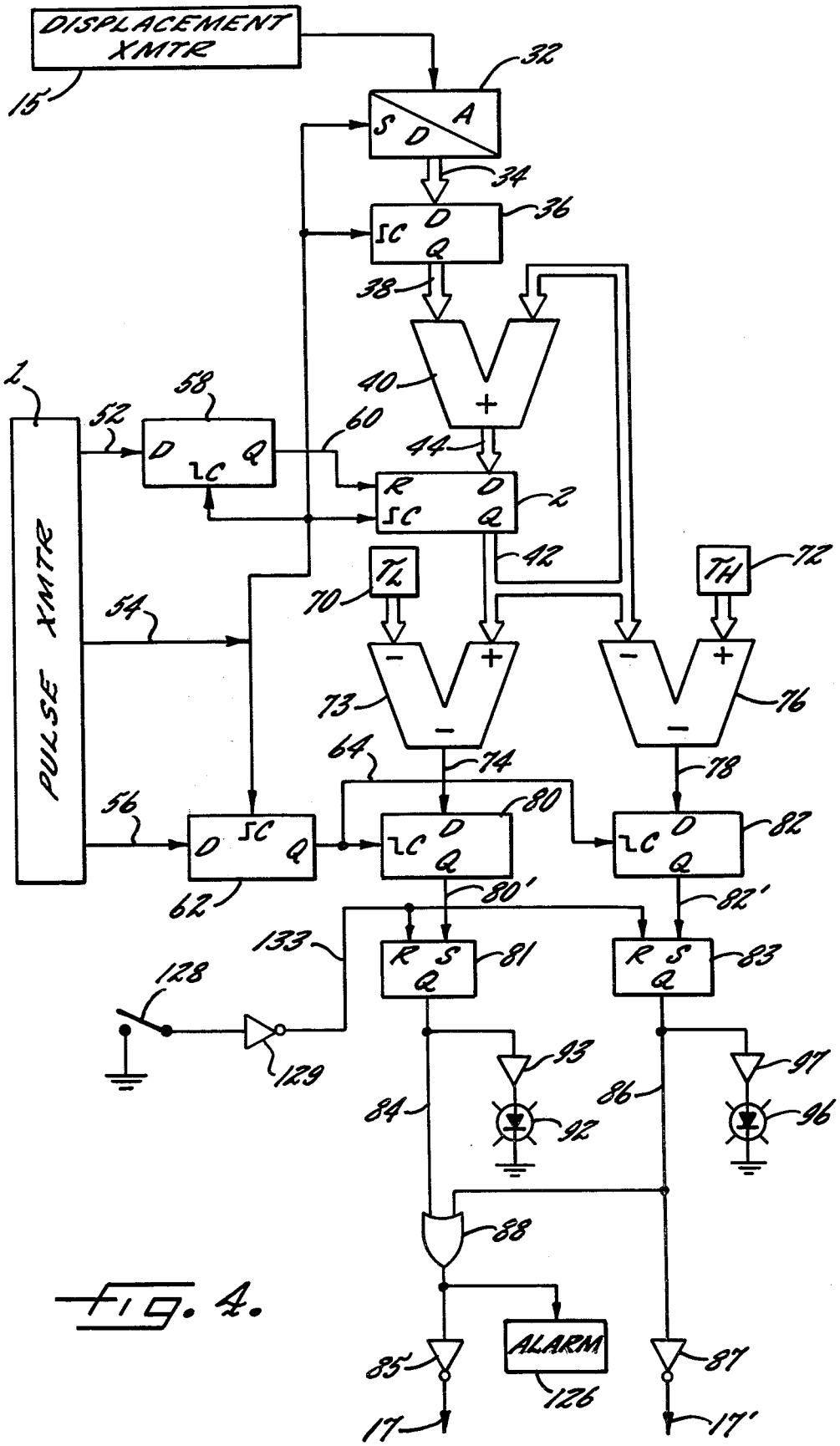
FIG. 4 is a circuit diagram of a synchronous logic design of the control circuitry.
Figure 5:
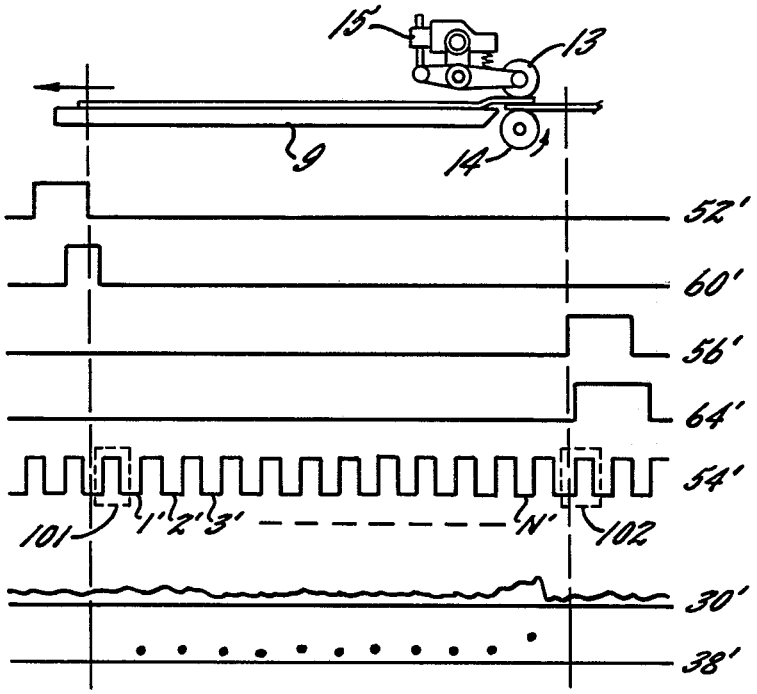
FIG. 5 is a timing diagram for the synchronous logic of FIG. 4.

A synchronous logic design for the digital control circuitry 4 of the sheet feed monitoring system is shown in FIG. 4 and may be understood with reference to the corresponding timing diagram of FIG. 5. A clock signal 54′ appearing on line 54 for synchronizing the logic elements is generated by the pulse transmitter 1 with a fixed number of transitions per rotation of the sheet feed rollers 13 and 14. The pulse transmitter 1 also generates an initial synchronization signal 52′ appearing on line 52 and a final synchronization signal 56′ appearing on line 56 which are generated by sensors coupled to the feed drive which, for example, activates mechanical motion of the sucker 8 or other feed means to push a sheet from the feed pile 7 into the feed roller mechanism generally designated 3 in FIG. 1. The initial and final synchronization signals, then, are periodic, occurring each time the feeder attempts to feed a sheet through the mechanism. As shown in FIG. 5, the initial synchronization signal, or more specifically the falling edge of this signal, should occur just after the sheet is engaged between rollers 13 and 14. The rising edge of the final synchronization signal should occur a short time before the sheet has passed through the rollers. The initial and final synchronization signals are themselves synchronized to the clock 54′ by D type flip-flops 58 and 62. These flip-flops in effect select pulses designated 101 and 102 in FIG. 5 as start and stop pulses, respectively, for the sampling of the thickness of the sheet measured by the displacement transmitter 15. Pulse 101 is the first pulse after the falling edge of the initial synchronization signal 52′ and pulse 102 is the first pulse after the rising edge of the final synchronization signal.

For every pulse of the clock 54′ between the start and stop pulses the thickness of the sheet is sampled. The displacement transmitter 15 generates an analog output signal 30′ on output line 30, increasing with the separation of rollers 13 and 14 and thus indicative of the thickness of the sheet between the rollers. A linear displacement transmitter is not required, and a nonlinear response is in fact desirable. A logarithmic response, for example, in which the sensitivity of the transducer decreases with increased displacement, will discount large displacements caused by irregularities such as folds or edge curls. The signal from the displacement transmitter 15 is sampled and converted by analog-to-digital converter means 32 to a numerical representation on the digital output bus 34 once for each transition of the clock 54′. An analog-to-digital converter is not required, of course, if the displacement transmitter 15 has a digital output signal. Latch register 36 guarantees that the numerical value transferred to bus 38 changes in synchronism with the rising edge of the clock 54′.

The numerical samples are accumulated over the length of the sheet in order to form a total value proportional to the average value of the sheet thickness. A running sum is stored in electronic storage means 2 comprising an accumulator register. The output of D flip-flop 58 is used as a reset signal appearing on line 60 to clear the accumulator register prior to receiving the first numerical sample. In other words, the numerical value appearing on the accumulator register output bus 42 after the rising edge of clock pulse 101 is zero. The numerical value on the output of latch 36 appearing on bus 38 is continuously added to the numerical value on the accumulator register output bus 42 by the combinational logic adder circuit 40. The sum is periodically received by the accumulator register 2 upon rising clock transitions designated 1′ to N′ in FIG. 5. In this fashion the register 2 has accumulated the total of the N′ displacement samples at the time of the rising edge of clock pulse 102.

The total numerical value, proportional to average sheet thickness, is compared to predetermined threshold values in order to generate signals indicative of a sheet missing or double sheet condition. The threshold values are, for example, set by digital thumbwheel switches 70 and 72. Thumbwheel 70 must be preset with the total numerical value corresponding to the minimum allowable sheet thickness. Thumbwheel 72, on the other hand, must be preset with the total numerical value corresponding to the maximum allowable sheet thickness. These threshold values are continuously compared to the numerical value on the accumulator register output bus 42 by combinatorial logic subtractor circuits 73 and 76. The sign bit, or most significant bit of the output of subtractor 73, appearing on line 74 is a logical one when the lower threshold exceeds the accumulator value. Similarly the sign bit on line 78 is a logical one when the accumulator exceeds the higher threshold.

The comparison indicating the double sheet or missing sheet condition must be a comparison with the total accumulated numerical value, and for this purpose latches 80 and 82 sample the comparison immediately after the rising edge of clock pulse 102. This is done by clocking the latch with the output of flip-flop 62 appearing on line 64. In effect, the comparison of the stored value in accumulator register 2 with the reference values preset on thumbwheel switches 70 and 72 is initiated by the final synchronization signal on line 56 that is the input to flip-flop 62. The output of latch 80 appearing on line 80' may then be used to trigger a set-reset flip-flop 81 such as a pair of cross-coupled NOR gates, which will indicate the occurrence of a sheet missing condition via light emitting diode 92 driven by buffer 93. Similarly the output of latch 82 on line 82' will trigger set-reset flip-flop 83 to indicate a double sheet condition via light-emitting diode 96 driven by buffer 97. The double sheet condition signal on line 86 is also buffered by inverting buffer 87 to generate the signal on line 17' for disengaging the magnetic couplng 18 and is combined with the missing sheet condition signal on line 84 by OR gate 88 for activating an alarm 126 and for closing the sucker air solenoid valve 19 which is normally held open by the output of inverting buffer 85 on line 17. Switch 128 and inverter 129 generate a signal on line 133 for resetting the flip-flops 81 and 83 or for holding the flip-flops in the reset state for disabling the sheet monitoring circuit from affecting the machine activating signals on lines 17 and 17'.

A drawback of the system just described is that manual calibration is required. The mechanical drive to feed rollers 13 and 14, for example, could be disconnected and an appropriate thickness gauge inserted between the rollers while the output line 80' or 82' of latch 80 or 82 is monitored as thumbwheel 70 or 72 is adjusted. The thumbwheel setting would correspond to the gauge thickness when the latch output changes. Additions and modifications to the circuit could make this calibration procedure semi-automatic, such as by replacing thumbwheel switches 70 and 72 with registers fed from bus 42 and clocked by line 64 gated with manual calibration enable switches for activation by the operator after the appropriate thickness gauge is inserted between the rollers.

The preferred implementation of the synchronous digital logic circuitry shown in FIG. 4 is accomplished using a microcomputer or other stored-sequence digital computing means. A microcomputer has added capabiities and simplfies calibration procedures and provides for adaptive re-calibration when the sheet feeder is running.

Figure 6:
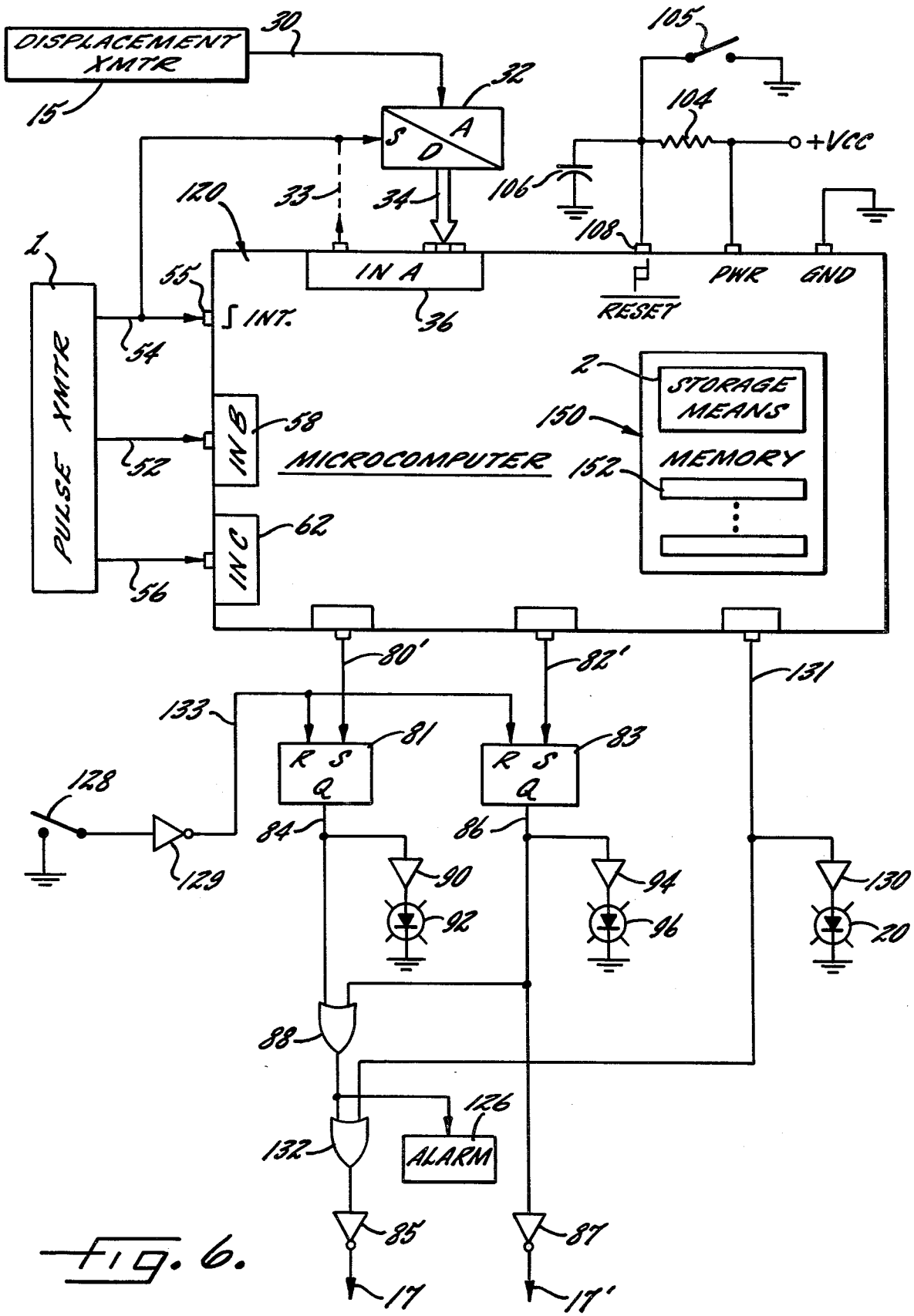
FIG. 6 is schematic diagram of a microcomputer-based control circuit.

A microcomputer implementation is shown in FIG. 6 corresponding to the sequential digital logic circuit of FIG. 4. The functions of latches and flip-flops 36, 58 and 62 are accomplished by input ports clocked when an input or "READ" instruction is executed. Flip-flops 80 and 82 are equivalent to output ports clocked when an output or "WRITE" instruction is executed. Line 54 may be used to trigger a sequence of microcomputer steps stored in the microcomputer 120 by connecting line 54 to an interrupt input 55 on the microcomputer 120, and storing the starting address of the interrupt sequence at the address of the interrupt vector. The interrupt sequence corresponding to the FIG. 4 circuit is shown in TABLE I (which for ready reference is located at the end of this specification). The microcomputer emulates the functions of the FIG. 4 circuit components by serially executing single steps with each step or series of related steps corresponding to a circuit component. Electronic storage 2 used for accumulating measuring device samples is one of many addressable storage locations in the microcomputer memory 150.

The READ IN_A step clocks in the numerical value on bus 34 analogous to latch register 36. Sequentially this numerical value is accumulated in memory storage 2 with address TOTAL. The memory location TOTAL is cleared, however, if the initial synchronization signal 52' read by the READ IN_B step is high, or in other words equal to a logical one. Next by subtraction steps the TOTAL is compared to reference values L_THRESH and H_THRESH previously stored in memory to arrive at differences MISS and DOUBLE. The most significant bits of these differences indicate the result of the comparison denoting whether a missing or double sheet is sensed, but only if the comparison is made when the TOTAL contains the accumulation of all of the required samples. Thus the contents of the MISS and DOUBLE memory locations are written to the output lines only if the final synchronization signal 56' on line 56 makes a low-to-high transition. A low-to-high transition is sensed by clocking in the final synchronization signal 56' by a READ IN_C instruction, and terminating the interrupt cycle if either IN_C is low, or equal to a logical zero, or if IN_C has not changed from its previous value stored in memory location STORE_C. Otherwise a low to high transition on line 54 must have occurred, and execution of the microcomputer procedure continues. The contents of the MISS and DOUBLE memory locations are transferred to output ports and strobed to output lines 80', 82' by the WRITE instructions to complete the interrupt cycle. The interrupt cycle repeats for each low to high transition of the clock 54' appearing on line 54.

Referring to FIG. 6, calibration can be made automatic by using a power-on reset sequence to "zero" the position transmitter 15. Resistor 104 and capacitor 106 generate the resetting signal on the microcomputer reset input 108, for a microcomputer with a Schmitt trigger reset asserted low input. Switch 105 is a manual reset switch. Just after the power is turned on, in the first cycle of the machine corresponding to the time a sheet would pass through the rollers 13 and 14, the sucker 8 is inhibited by the signal on line 131 to OR gate 132 and thus no sheet is fed. Light-emitting diode 20 driven by driver 130 indicates this start-up mode. The total numerical value of the roller displacement is calculated during this first machine cycle and added to the expected sheet thickness to more accurately estimate the threshold values. This estimate in effect compensates for variations in the offset of the position transmitter. After a number of sheet passes through the feed rollers the expected sheet thickness may be replaced with the average sheet thickness measured over the sheet passes, and the thickness may be continuously monitored and the threshold values adapted while the machine is running.

An interrupt sequence for automatic calibration is listed in TABLE II appended to the specification. Upon sensing a low-to-high transtion on the reset input 108, the microcomputer sequentially executes steps starting at RESET, the address stored at the reset vector address. A logical 1 is written to OUT_F and appears as a high signal on line 131 to indicate that the reset calibration cycle has started. The microcomputer remembers that it is in the reset calibration cycle by storing a logical zero at memory location CYCLE. A flag CLEAR is also cleared to indicate when the accumulator TOTAL is first cleared. A flag TABLE_EMPTY is set to indicate that a table, MEMORY_TABLE 152 in memory 150 for storing measured sheet thickness, is empty. The table pointer INDEX is then cleared. This completes the RESET sequence and the microcomputer continues with other steps in a main program until an interrupt occurs. The main program could be simply a continuous loop instruction such as "LOOP GO TO LOOP" but it should be appreciated that by using an interrupt routine to service the sheet feed monitoring system, totally unrelated microcomputer procedures may be executed in a separate main program.

When an interrupt occurs the INTERRUPT sequence is executed in a similar manner as the sequence in TABLE I. The flag CLEAR is set when the accumulator TOTAL is cleared and is used to inhibit the sensing of the low-to-high transition of the final synchronization input IN_C unless the accumulator was previously cleared. This ensures that a summation of all the samples is obtained when the FULL_ACCUM. step is reached even though, for example, when the machine was turned on the final synchronization pulse 56' was received before an initial synchronization pulse 52'. The first time the FULL_ACCUM. step is reached, CYCLE is zero and the reset calibration proceeds with steps ZERO and following.

To zero the displacement transmitter 15, the microcomputer first sets CYCLE to 1 to insure that the ZERO procedure will not be executed for following sheet-feed cycles. Then the OFFSET is just the previously calculated TOTAL. Memory location THICK is loaded with a predetermined constant EXPECTED_THICKNESS for use until the thickness of sheets may be calculated in the following sheet feed cycles. OUT_F is cleared and a WRITE instruction is executed to indicate that the power-on reset sequence is completed. The values OFFSET and THICK are used to calculate the low and high thresholds L_THRESH and H_THRESH by forming an intermediate sum in STORE_D and subtracting or adding a predetermined tolerance.

Adaptive recalibration is performed during the following sheet feed cycles by averaging measured values of detected sheets. If a miss or double sheet is detected the measured values are not used. Execution returns to the main program from the interrupt routine if either MISS or DOUBLE is a logical one. Otherwise the thickness of the sheet is computed as TOTAL—OFFSET and stored in the next available MEMORY_TABLE address determined by incrementing the table pointer INDEX. If the pointer INDEX is 4 or larger, the table is full and INDEX is cleared to cyclically store following measured values. The TABLE_EMPTY flag is also cleared so that an average of the stored measured values in MEMORY_TABLE 152 may be calculated when the table is full. The average is calculated by clearing an accumulator TOTAL_THICK and accumulating the table entries using J as a pointer. The sum is averaged by dividing by 4, which is easily done in the microcomputer by arithmetically shifting the contents of TOTAL_THICK two binary places to the right. The average is used as THICK for re-calculation of the threshold values.

A microcomputer also has its own clock, so that the pulse transmitter 1 need not generate a periodic clock 54'. The microcomputer procedure may be adapted to periodically request and receive samples from the A/D converter 32. In this case, the number of samples, N', would be variable depending on the velocity of the sheet feed. But the microcomputer can easily correct for a variable number of samples by counting the number of samples, and calculating a mean measured value by dividing the accumulation of the measured values by the number of samples. A representative procedure is shown in TABLE III appended to the specification. For this procedure, it is assumed that the microcomputer 120 has a strobe line 33 alternately shown in FIG. 6 from input port 36 to strobe the A/D converter 32 each time the input port is read, and it is also assumed that there is no connecting line 54 to the microcomputer interrupt input 55. The procedure, a modification of the procedure shown in TABLE II, is part of the main program and is periodically executed. The last step, "GO TO MAIN", repeats the cycle for each sample. To accommodate a variable number of samples per cycle, a memory location COUNT is used to count the number of samples and a mean value MEAN is calculated in the DIVIDE step and is used in place of TOTAL in following steps.

Figure 7:
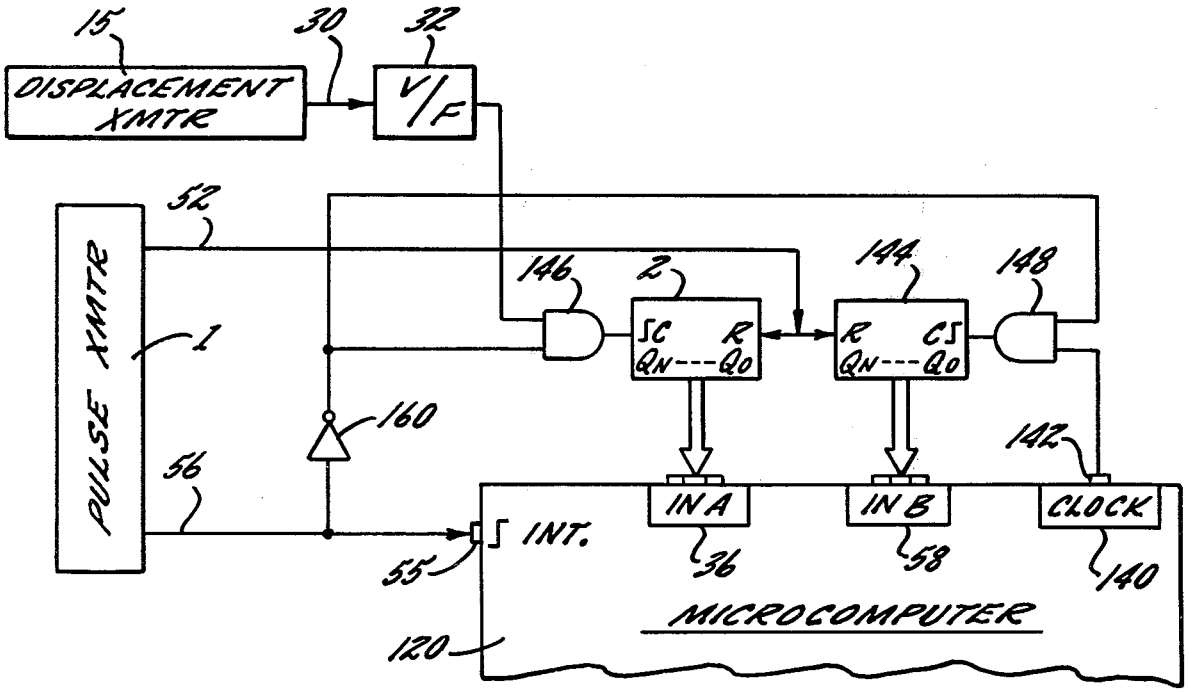
FIG. 7 shows a microcomputer-based system using a voltage-to-frequency type analog-to-digital converter.

The microcomputer 120 may also be easily adapted to use a voltage-to-frequency converter 32 for the analog-to-digital conversion, as shown in FIG. 7. An external binary ripple counter may then be used for the accumulating electronic storage means 2. Another binary ripple counter 144 may be used as a reference timer, clocked by the microcomputer's clock 140 appearing on a clock pin 142. The binary ripple counters 2 and 144 are reset by the initial synchronization pulse on line 52 and read by the microcomputer 120 on interrupt by the final synchronization pulse on line 56. The final synchronization pulse also inhibits the counters 2, 144 via AND gates 146, 148 driven by inverter 160 so that the counters 2, 144 will not be rippling when they are read by the microcomputer 120. The mean measured signal is the average frequency over the measuring interval, or the number of counts accumulated in counter 2 divided by the time period registered in counter 144. The microcomputer procedure in TABLE II, as modified in TABLE IV appended to the specification, may be used. It should be noted that the microcomputer does not sense the initial synchronization pulse 52' and thus the counters 2 and 144 may not have been reset prior to the first interrupt. To compensate for this condition, the first interrupt is sensed by checking if CLEAR is a ZERO. If so, execution returns to the main program immediately after CLEAR is set.

While the invention is susceptible of various modifications and alternative constructions, it should be understood that there is no intention to limit the invention to the specific forms disclosed, but on the contrary, the intention is to cover all modifications, alternative constructions and equivalents falling within the spirit and scope of the invention as defined by the appended claims.

TABLE I

| MICROCOMPUTER STEPS FOR EMULATION OF THE CIRCUIT SHOWN IN FIG. 5 | |
|---|---|
| INTERRUPT | READ IN_A |
| | TOTAL ← TOTAL + IN_A |
| | READ IN_B |

TABLE I-continued

| MICROCOMPUTER STEPS FOR EMULATION OF THE CIRCUIT SHOWN IN FIG. 5 | |
|---|---|
| | IF IN_B = 1 THEN TOTAL ← 0 |
| | MISS ← TOTAL − L_THRESH |
| | DOUBLE ← H_THRESH − TOTAL |
| | READ IN_C |
| | IF IN_C = 0 THEN RETURN |
| | IF IN_C = STORE_C THEN RETURN |
| | STORE_C ← IN_C |
| | OUT_D ← MISS |
| | OUT_E ← DOUBLE |
| | WRITE OUT_D |
| | WRITE OUT_E |
| | RETURN |

TABLE II

| MICROPROCESSOR STEPS FOR THE CIRCUIT SHOWN IN FIG. 6 AND INCLUDING AUTOMATIC RESTART CALIBRATION AND ADAPTIVE RE-CALIBRATION PROCEDURES | |
|---|---|
| RESET | OUT_F ← 1 |
| | WRITE OUT_F |
| | CLEAR ← 0 |
| | CYCLE ← 0 |
| | TABLE_EMPTY ← 1 |
| | INDEX ← 0 |
| | (GO TO MAIN PROGRAM) |
| INTERRUPT | READ IN_A |
| ACCUMULATE | TOTAL ← TOTAL + IN_A |
| | READ IN_B |
| | IF IN_B = 1 THEN TOTAL ← 0 |
| | IF IN_B = 1 THEN CLEAR ← 1 |
| | STORE_C ← IN_C |
| | READ IN_C |
| | IF CLEAR = 0 THEN RETURN |
| | IF IN_C = THEN RETURN |
| | IF IN_C = STORE_C THEN RETURN |
| FULL_ACCUM. | IF CYCLE = 0 THEN GO TO ZERO |
| | MISS ← TOTAL − L_THRESH |
| | DOUBLE ← H_THRESH − TOTAL |
| | OUT_D ← MISS |
| | OUT_E ← DOUBLE |
| | WRITE OUT_D |
| | WRITE OUT_E |
| | GO TO ADAPT |
| ZERO | CYCLE ← 1 |
| | OFFSET ← TOTAL |
| | THICK ← EXPECTED_THICKNESS |
| | OUT_F ← 0 |
| | WRITE OUT_F |
| THRESH_CALC | STORE_D ← OFFSET + THICK |
| | L_THRESH ← STORE_D − L_TOLERANCE |
| | H_THRESH ← STORE_D + H_TOLERANCE |
| | RETURN |
| ADAPT | IF MISS = 1 THEN RETURN |
| | IF DOUBLE = 1 THEN RETURN |
| | INDEX ← INDEX + 1 |
| | MEMORY_TABLE (INDEX) ← TOTAL − OFFSET |
| | IF INDEX ≦ 3 THEN GO TO SKIP |
| | INDEX ← 0 |
| | TABLE_EMPTY ← 0 |
| SKIP | IF TABLE_EMPTY = 1 RETURN |
| | J ← 0 |
| | TOTAL _THICK ← 0 |
| SUM | J ← J + 1 |
| | TOTAL_THICK ← TOTAL_THICK + MEMORY_TABLE (J) |
| | IF J ≦ 3 THEN GO TO SUM |
| AVERAGE | THICK ← TOTAL_THICK/4 |
| | GO TO THRESH_CALC |

TABLE III

| MICROCOMPUTER STEPS FOR THE CIRCUIT SHOWN IN FIG. 6 WITH SOFTWARE CLOCKING IN LIEU OF HARDWARE INTERRUPT | |
|---|---|
| RESET | OUT_F ← 1 |
| | WRITE OUT_F |
| | CYCLE ← 0 |
| | CLEAR ← 0 |
| | TABLE_EMPTY ← 1 |

TABLE III-continued

| MICROCOMPUTER STEPS FOR THE CIRCUIT SHOWN IN FIG. 6 WITH SOFTWARE CLOCKING IN LIEU OF HARDWARE INTERRUPT | |
|---|---|
| | INDEX ← 0 |
| MAIN | READ IN_A |
| | COUNT ← COUNT + 1 |
| ACCUMULATE | TOTAL ← TOTAL + IN_A |
| | READ IN_B |
| | IF IN_B = 0 THEN GO TO PASS |
| | TOTAL ← 0 |
| | COUNT ← 0 |
| | CLEAR ← 1 |
| PASS | STORE_C ← IN_C |
| | READ IN_C |
| | IF CLEAR = 0 THEN GO TO SERVICE |
| | IF IN_C = 0 THEN GO TO SERVICE |
| | IF IN_C = STORE_C THEN GO TO SERVICE |
| DIVIDE | MEAN ← TOTAL/COUNT |
| | IF CYCLE = 0 THEN GO TO ZERO |
| | MISS ← MEAN − L_THRESH |
| | DOUBLE ← H_THRESH − MEAN |
| | OUT_D ← MISS |
| | OUT_E ← DOUBLE |
| | WRITE OUT_D |
| | WRITE OUT_E |
| | GO TO ADAPT |
| ZERO | CYCLE ← 1 |
| | OFFSET ← MEAN |
| | THICK ← EXPECTED_THICKNESS |
| | OUT_F ← 0 |
| | WRITE OUT_F |
| THRESH_CALC | STORED ← OFFSET + THICK |
| | L_THRESH ← STORED − L_TOLERANCE |
| | H_THRESH ← STORED + H_TOLERANCE |
| | GO TO SERVICE |
| ADAPT | IF MISS = 1 THEN GO TO SERVICE |
| | IF DOUBLE = 1 THEN GO TO SERVICE |
| | INDEX ← INDEX + 1 |
| | MEMORY_TABLE (INDEX) ← MEAN − OFFSET |
| | IF INDEX ≦ 3 THEN GO TO SKIP |
| | INDEX ← 0 |
| | TABLE_EMPTY ← 0 |
| SKIP | IF TABLE_EMPTY = 1 THEN GO TO SERVICE |
| | J ← 0 |
| | TOTAL_THICK ← 0 |
| SUM | J ← J + 1 |
| | TOTAL_THICK ← TOTAL_THICK + MEMORY_TABLE (J) |
| | IF J ≦ 3 THEN GO TO SUM |
| AVERAGE | THICK ← TOTAL_THICK/4 |
| | GO TO THRESH_CALC |
| SERVICE | [SERVICE OTHER MICROCOMPUTER PROCEDURES] |
| | GO TO MAIN |

TABLE IV

| MICROCOMPUTER STEPS FOR THE CIRCUIT SHOWN IN FIG. 7 | |
|---|---|
| | . . . |
| INTERRUPT | IF CLEAR = THEN GO TO INIT |
| | READ IN_A |
| | READ IN_B |
| | TOTAL ← IN_/IN_B [CALCULATE FREQUNECY] |
| FULL ACCUM. | IF CYCLE = 0 THEN GO TO ZERO |
| | MISS ← TOTAL − L_THRESH |
| | DOUBLE ← H_THRESH − TOTAL |
| | OUT_D ← MISS |
| | OUT_E ← DOUBLE |
| | . . . |
| | [CONTINUE AS IN TABLE II] |
| | . . . |
| INIT | CLEAR ← 1 |
| | RETURN |

I claim as my invention:

1. A method of determining whether a sheet feed mechanism is feeding a predetermined number of superimposed sheets to a sheet processing machine during a given feed cycle comprising the steps of:

obtaining a plurality of measured values that are functionally related to sheet thickness at distinct points on the surface of the superimposed sheets, while the superimposed sheets are passing to the sheet processing machine, converting the measured values to digital, numeric representation, totalling the numeric values in a digital accumulator register, and comparing the total to a predetermined reference value, wherein the reference value is computed by averaging the totals obtained from previous sheet feeds where single sheet feeds were detected.

2. The method of claim 1 further comprising the step of calculating a mean value by dividing the total by the number of measured values for use in other calculations in place of the total.

3. The method of claim 1 wherein the references value is at first predetermined by prohibiting the superimposed sheets from being fed and computing the reference value by a method comprising the steps of:

obtaining, while the superimposed sheets are not being fed, a plurality of measured offset values representative of the offset errors inherent in the measured values obtained when the superimposed sheets are later fed by the sheet feed mechanism, converting the measured offset values to digital, numeric representation, totalling the numeric offset values in a digital accumulator register, and computing the reference value from the total of numeric offset values.

4. A method of determining whether a sheet feed mechanism is feeding a predetermined number of superimposed sheets to a sheet processing machine during a given feed cycle comprising the steps of:

obtaining a plurality of measured values that are functionally related to sheet thickness at distinct points on the surface of the superimposed sheets, while the superimposed sheets are passing to the sheet processing machine, converting the measured values to digital, numeric representation, totalling the numeric values in a digital accumulator register, comparing the total to a predetermined reference value, and calculating a mean value by dividing the total by the number of measured values for use in other calculations in place of the total.

5. The method of claim 4 wherein the reference value is at first predetermined by prohibiting the superimposed sheets from being fed and computing the reference value by a method comprising the steps of:

obtaining, while the superimposed sheets are not being fed, a plurality of measured offset values representative of the offset errors inherent in the measured values obtained when the superimposed sheets are later fed by the sheet feed mechanism, converting the measured offset values to digital, numeric representation, totalling the numeric offset values in a digital accumulator register, and computing the reference value from the total of numeric offset values.

6. A system for determining whether sheets are properly fed by a variable-speed sheet feed mechanism to a sheet processing machine comprising:

a measuring device generating an electrical signal responsive to the number of superimposed sheets fed to the sheet processing machine;

a pulse transmitter synchronized with the sheet feed mechanism for emitting an initial pulse approximately at the time the fed sheet passes to the measuring device and a final pulse approximately at the time the fed sheet passes from the measuring device;

means for periodically sampling the electronic signal from the measuring device, a digital register providing a storage means for accumulating the samples of the electronic signal, means for obtaining a total count equal to the value accumulated in the digital register from the time of the initial pulse to the time of the final pulse, means for obtaining from the total count a mean measured value representing the average sheet thickness independent of the sheet feed velocity, and means for producing a double sheet alarm signal when the mean measured value exceeds a predetermined reference value by a predetermined upper tolerance value and a missing sheet signal when the mean measured value falls below the reference by more than a predetermined lower tolerance value, wherein the means for obtaining from the total count a mean measured value independent of the sheet feed velocity comprises a microcomputer, the microcomputer having means for counting the number of samples accumulated to obtain the total count and means for dividing the total count by the counted number of samples to obtain the mean measured value independent of the sheet feed velocity.

7. The system as recited in claim 6 wherein the microcomputer further comprises a plurality of N storage registers in which the last N mean measured values calculated are cyclically stored, whereby the total of the last N mean measured values is calculated for use in adaptive adjustment of the reference value.

8. The system as recited in claim 6 wherein the microcomputer includes means for outputting a sheet feed inhibiting signal when the sheet feed mechanism is started, and means for calculating the reference value as a predetermined expected thickness of the sheets plus the mean measured value computed while said feed inhibiting signal is being outputted, whereby the mean measured value without sheets is calculated and used for automatic offset adjustment.

9. The system as recited in claim 6 wherein the measuring device generates an electrical signal which is approximately a logarithmic function of the number of superimposed sheets.

10. The system as recited in claim 6 wherein the microcomputer has means for generating numeric values from the measuring device signal which increase approximately logarithmically in value with the number of superimposed sheets.

* * * * *